US011113920B2

(12) United States Patent
Qu et al.

(10) Patent No.: US 11,113,920 B2
(45) Date of Patent: Sep. 7, 2021

(54) BANKNOTE STACKING AND SEPARATING APPARATUS AND BANKNOTE PROCESSING DEVICE

(71) Applicant: Shandong New Beiyang Information Technology Co., Ltd., Shandong (CN)

(72) Inventors: Ping Qu, Shandong (CN); Zhenxing Zhao, Shandong (CN); Bingqing Liu, Shandong (CN); Chuntao Wang, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 197 days.

(21) Appl. No.: 16/498,198

(22) PCT Filed: Mar. 15, 2018

(86) PCT No.: PCT/CN2018/079089
§ 371 (c)(1),
(2) Date: Sep. 26, 2019

(87) PCT Pub. No.: WO2018/177125
PCT Pub. Date: Oct. 4, 2018

(65) Prior Publication Data

US 2021/0104113 A1 Apr. 8, 2021

(30) Foreign Application Priority Data

Mar. 29, 2017 (CN) ..... 201710199770.7

(51) Int. Cl.
*B65H 83/02* (2006.01)
*G07D 11/165* (2019.01)
(Continued)

(52) U.S. Cl.
CPC ..... *G07D 11/165* (2019.01); *B65H 3/06* (2013.01); *B65H 29/00* (2013.01); *G07D 11/13* (2019.01);
(Continued)

(58) Field of Classification Search
CPC ..... B65H 83/00; B65H 83/02; B65H 83/025; B65H 29/00; B65H 3/06; B65H 2701/1912
See application file for complete search history.

(56) References Cited

U.S. PATENT DOCUMENTS 7,722,024 B2 * 5/2010 Jeong ..... B65H 83/025 271/3.08
7,918,444 B2 * 4/2011 Balahan ..... B65H 3/60 271/37
(Continued)

FOREIGN PATENT DOCUMENTS

CN 101097449 A 1/2008
CN 102007059 A 4/2011
(Continued)

OTHER PUBLICATIONS

International Search Report dated May 17, 2018, in the International Application No. PCT/CN2018/079089, 4 pages.

*Primary Examiner* — Howard J Sanders
(74) *Attorney, Agent, or Firm* — Wilmer Cutler Pickering Hale and Dorr LLP

(57) ABSTRACT

A banknote stacking and separating apparatus includes a frame, and a guide plate and a pressing plate that are disposed on the frame. The frame is provided with an entrance-and-exit for a banknote. One end of the guide plate adjacent to the entrance-and-exit is pivotally connected to the frame, and the guide plate is operative to rotate around an axis of a pivoting shaft and is configured to guide a moving direction of the banknote when the banknote is
(Continued)

being collected. The pressing plate is configured to support the collected banknotes and press the banknotes towards the guide plate while the banknotes are being separated. One end of the guide plate far away from the entrance-and-exit is provided with a force-releasing surface configured to support the guide plate when the pressing plate presses the banknotes towards the guide plate.

20 Claims, 5 Drawing Sheets

(51) Int. Cl.
*G07D 11/13* (2019.01)
*B65H 3/06* (2006.01)
*B65H 29/00* (2006.01)

(52) U.S. Cl.
CPC .... *B65H 83/025* (2013.01); *B65H 2701/1912* (2013.01); *G07D 2211/00* (2013.01)

(56) References Cited

U.S. PATENT DOCUMENTS

| | | | | |
|---|---|---|---|---|
| 9,070,241 | B2 * | 6/2015 | Fujita | G07D 11/13 |
| 9,240,087 | B2 * | 1/2016 | Billet | G07D 11/13 |
| 9,540,193 | B2 * | 1/2017 | Fukumoto | B65H 1/18 |
| 2009/0152805 | A1 * | 6/2009 | Nomiyama | B65H 31/20 271/227 |
| 2011/0031308 | A1 * | 2/2011 | Holland-Letz | B65H 1/022 235/379 |
| 2011/0031673 | A1 * | 2/2011 | Sugizaki | B65H 31/02 270/32 |
| 2018/0082507 | A1 * | 3/2018 | Park | B65H 31/26 |
| 2020/0010301 | A1 * | 1/2020 | Qu | G07D 11/18 |

FOREIGN PATENT DOCUMENTS

| | | | |
|---|---|---|---|
| CN | 102087765 | A | 6/2011 |
| CN | 103258367 | A | 8/2013 |
| JP | 2006-021860 | A | 1/2006 |

* cited by examiner

BANKNOTE STACKING AND SEPARATING APPARATUS AND BANKNOTE PROCESSING DEVICE

CROSS REFERENCE TO RELATED APPLICATIONS

This application is a U.S. National Phase Application of International Patent Application No. PCT/CN2018/079089, filed on Mar. 15, 2018, entitled "BANKNOTE ACCUMULATION/SEPARATION DEVICE AND BANKNOTE PROCESSING DEVICE," which claims priority to China Patent Application No. 201710199770.7, filed Mar. 29, 2017, entitled "BANKNOTE ACCUMULATION/SEPARATION DEVICE AND BANKNOTE PROCESSING DEVICE," before the State Intellectual Property Office of People's Republic of China, the disclosures of each of which is incorporated herein by reference in its entirety.

TECHNICAL FIELD

The present disclosure relates to the technical field of automated machinery, for example, to a banknote stacking and separating apparatus and a banknote processing apparatus.

BACKGROUND

A banknote processing device is typically provided with a banknote stacking and separating apparatus for collecting and separating banknotes. FIG. 1 is a structural schematic view of a banknote stacking and separating apparatus provided in the related art. As shown in FIG. 1, the banknote stacking and separating apparatus includes a housing 1', an opening 2', a feed roller 3', a gate roller 4', a pickup roller 5', a guide plate 6', a transfer passage 7', a banknote storage chamber 8', and a pressing plate 9'. The opening 2 'is provided at an upper end of the housing. The banknote storage chamber 8' is disposed inside the housing 1'. The feed roller 3' and the gate roller 4' are disposed at a side of the banknote storage chamber 8' adjacent to the opening 2 '. The feed roller 3' and the gate roller 4 'are oppositely disposed to form an entrance-and-exit for a banknote to enter and exit the banknote storage chamber 8'. The pickup roller 5 'and the guide plate 6' are disposed inside the banknote storage chamber 8' and are disposed downstream of the entrance-and-exit along a direction in which the banknote enters the banknote storage chamber 8'. The position of the pickup roller 5' relative to the entrance-and-exit is adjustable, and the pickup roller 5' has an initial position and a banknote pickup position. The position of the guide plate 6' relative to the entrance-and-exit is adjustable, and has a banknote entry and a lifting position. The transfer passage 7' is connected between the opening 2' and the entrance-and-exit, and the pressing plate 9' is disposed in the banknote storage chamber 8'. When the banknote stacking and separating apparatus is collecting banknotes, as shown in FIG. 1, the guide plate 6' is at the banknote entry, the pickup roller 5' is at its initial position, the guide plate 6' hides the pickup roller 5', so that the banknotes are input from the entrance-and-exit and then are stacked onto the banknotes pressing plate 9' under the guide of the guide plate 6', while the banknotes do not contact with the pickup roller 5'. When the banknote stacking and separating apparatus is separating banknotes, the pressing plate 9' moves upwards to drive the guide plate 6' to rotate clockwise in the illustration of FIG. 1 thus exposing the pickup roller 5'. As such, the pressing plate 9' lifts the pickup roller 5', and the banknotes are pressed against the pickup roller 5' at a predetermined pressure. At this moment, the pickup roller 5' rotates and drives the banknote contacting with the pickup roller 5' to move towards the feed roller 3'. Then the feed roller 3' and the gate roller 4' drive a single banknote to pass through the transfer passage 7 ' to be output via the opening 2'.

In the banknote stacking and separating apparatus in the related art, the movement of banknotes toward the entrance-and-exit is hindered when separating banknotes, which is not favorable for smooth separation of banknotes, such that the banknote entering the delivery path 7' may be folded or skewed. In addition, intervals between banknotes successively output by the banknote stacking and separating apparatus may be unsteady. Therefore, the banknote stacking and separating apparatus in the related art has the problem that the banknotes have an unstable state when they are separated.

SUMMARY

The present disclosure provides a banknote stacking and separating apparatus and a banknote processing device, to solve the problem in the related art that banknotes' state are unstable when separating banknotes using the banknote stacking and separating apparatus. The banknote stacking and separating apparatus includes: a frame, and a guide plate and a pressing plate that are disposed on the frame. The frame is provided with an entrance-and-exit for a banknote. One end of the guide plate adjacent to the entrance-and-exit is pivotally connected to the frame, and the guide plate is rotatable around an axis of a pivoting shaft and is configured to guide a moving direction of the banknote when the banknote is being collected. The pressing plate is configured to support the collected banknote and press the banknotes towards the guide plate when the banknote is being separated. One end of the guide plate far away from the entrance-and-exit is provided with a force-releasing portion configured to support the guide plate when the pressing plate presses the banknote towards the guide plate, thus creating a gap between the guide plate and the banknote supported by the pressing plate.

Optionally, the force-releasing portion is provided with a force-releasing surface facing an end of the pressing plate far away from the entrance-and-exit and forms an acute angle with a surface of the banknote supported by the pressing plate.

Optionally, when the pressing plate presses the banknote toward the guide plate, and the force-releasing surface contacts an end surface of the banknote and pushes the banknote to move towards the entrance-and-exit.

Optionally, the force-releasing surface is a plane or an arc surface protruding towards the pressing plate.

Optionally, the force-releasing portion is pivotally connected to the guide plate and is rotatable relative to the guide plate. The guide plate is provided with a first limiting portion disposed on a rotating path of the force-releasing portion rotating in a direction away from the pressing plate. And when it abuts against the first limiting portion, the force-releasing portion is at an initial position.

Optionally, the banknote stacking and separating apparatus further includes a first elastic member connected between the guide plate and the force-releasing portion and is configured to allow the force-releasing portion to have a permanent tendency of rotating toward the initial position.

Optionally, the banknote stacking and separating apparatus further includes a blocking portion disposed on the frame. When the force-releasing portion at the initial position rotates along with the guide plate in a direction away from the pressing plate, the blocking portion is operative to make the force-releasing portion rotate relative to the guide plate in a direction of nearing the pressing plate allowing the force-releasing portion to support the guide plate.

Optionally, when the force-releasing portion rotates relative to the guide plate in a direction of nearing the pressing plate, the force-releasing surface is operative to push the banknote contacting with the force-releasing surface to move towards the entrance-and-exit.

Optionally, the frame includes a housing, and the blocking portion is configured to be a side wall of the housing.

A banknote processing device includes the banknote stacking and separating apparatus described above.

The banknote stacking and separating apparatus provided by the present disclosure includes a frame, and a guide plate and a pressing plate that are disposed on the frame. One end of the guide plate far away from the entrance-and-exit is provided with the force-releasing portion configured for supporting the guide plate when the pressing plate presses the banknote towards the guide plate thus creating a gap between the guide plate and the banknote supported by the pressing plate. When the banknotes are separated, the pressing plate first moves towards the guide plate so that the force-releasing portion contacts an end surface of the banknote, and the guide plate is supported by the force-releasing portion under the action of the pressing plate to create a gap between the guide plate and the banknote. Compared with the related art, banknote stacking and separating apparatus provided by the present disclosure has advantages that when the banknotes are separated, the force-releasing portion is operative to support the guide plate, so that the guide plate does not contact with banknote, and the force-releasing portion only contacts an end portion of the banknote. Thus, the guide plate does not block the separation and output of the banknote, so that it is guaranteed that the banknote stacking and separating apparatus can steadily separate banknotes.

Figure 1:
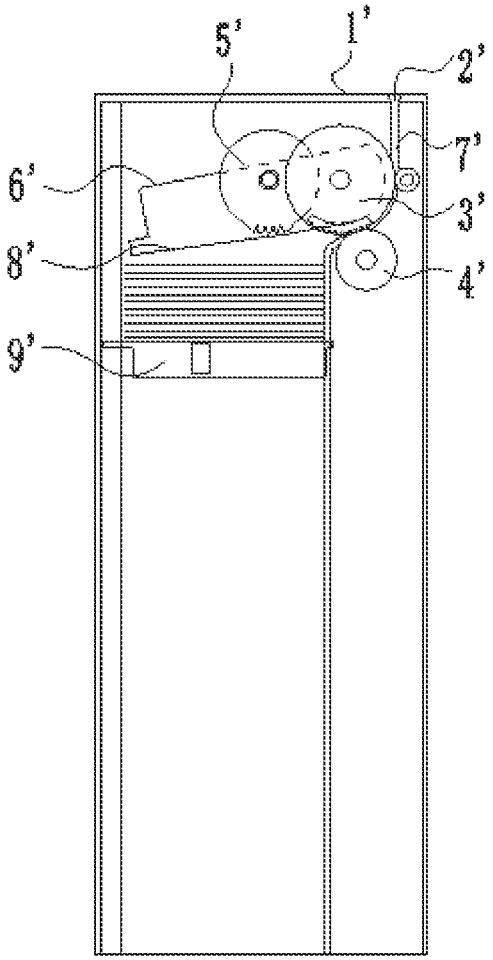
FIG. 1 PRIOR ART
FIG. 1 is a structural schematic view of a banknote stacking and separating apparatus provided in the related art.

In the drawings: 1—Frame; 2—Stacking and separating mechanism; 3—Banknote pressing mechanism; 4—Guiding mechanism; 10—Housing; 11—Opening; 12—Banknote storage chamber; 13—Transfer passage; 14—Elongated slot; 15—Second limiting portion; 16—First side wall; 17—Second side wall; 18—Blocking portion; 20—Entrance-and-exit; 21—Feed roller; 22—Gate roller; 23—Pickup roller; 24—Impeller; 211—Core shaft; 231—Supporting frame; 31—Pressing plate; 32—Banknote pressing driving member; 33—Guide wheel; 321—Driving belt; 322—Pulley; 41—Guide plate; 42 Force-releasing portion; 43—Shaft; 44—Elastic member; 411—Guide surface; 412—First limiting portion; 421—Force-releasing surface; 100—Deposit and withdrawal port mechanism; 200—Identification mechanism; 300—Temporary storage mechanism; 400—Circulating banknote box; 500—Delivery mechanism; 600—Recovery box.

DETAILED DESCRIPTION

The present disclosure will be described hereinafter in conjunction with the drawings.

In the description of the present embodiment, it is to be understood that the orientational or positional relationships defined by terms "center", "above", "below", "left", "right", "vertical", "horizontal", "inside", "outside" and the like are based on the orientational or positional relationships illustrated in the drawings, which are intended for the mere purpose of facilitating description, where these relationships do not indicate or imply that the discussed apparatus or components must have a specific orientation and is constructed and operated in a specific orientation. Moreover, terms like "first" and "second" are merely for description and are not to be construed as indicating or implying relative importance. And the terms "first position" and "second position" are two different positions.

In the present embodiment, unless otherwise expressly specified and defined, terms like "mounted", "connected to each other", "connected" are to be construed in a broad sense, for example, as permanently connected, detachably connected or integratedly connected; mechanically connected or electrically connected; directly connected or indirectly connected via an intermediate medium; or internally connected between two elements.

The implementations of the present disclosure are described hereinafter by way of specific embodiments in conjunction with the accompanying drawings.

Figure 2:
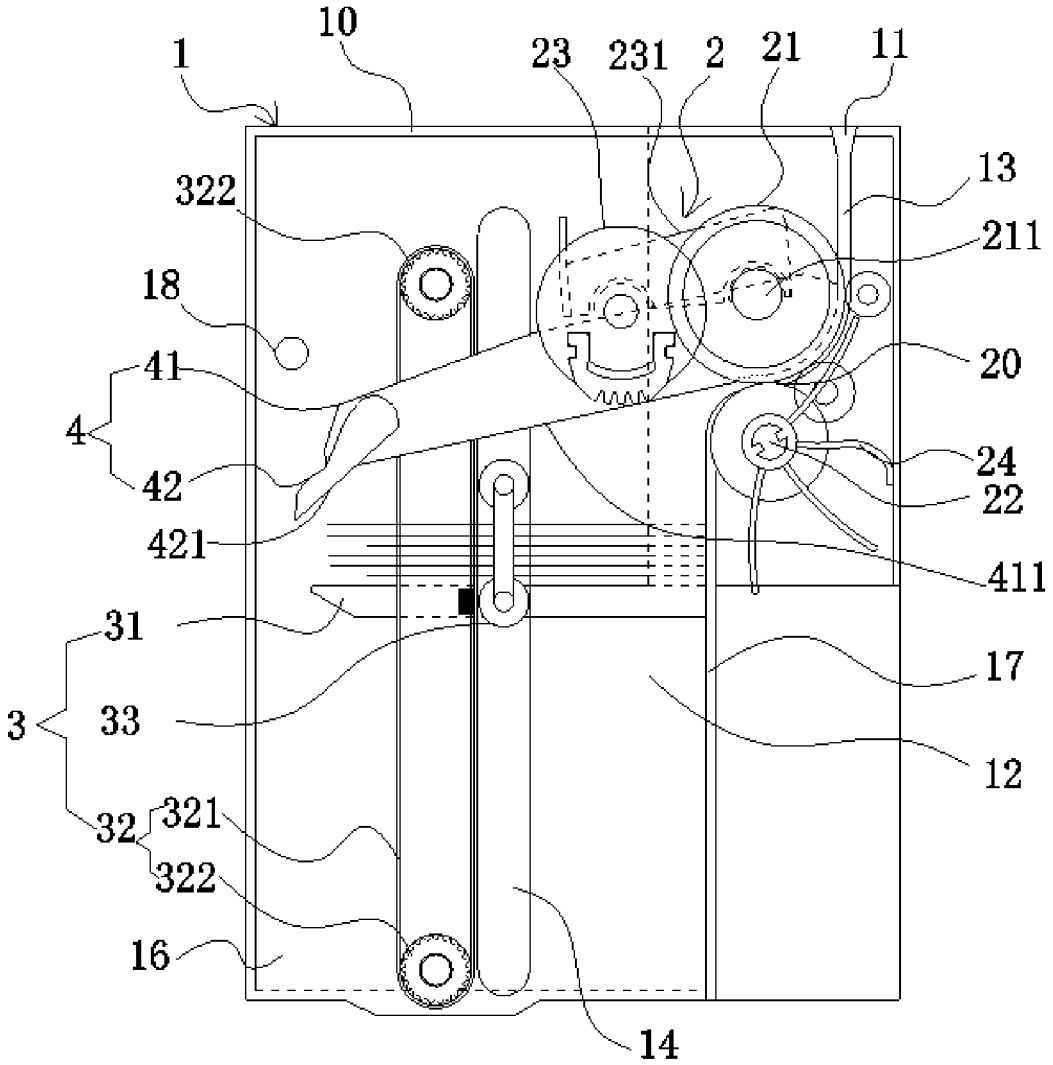
FIG. 2 is a structural schematic view of a banknote stacking and separating apparatus according to an embodiment of the present disclosure.

FIG. 2 is a structural schematic view of a banknote stacking and separating apparatus according to an embodiment of the present disclosure. As illustrated in FIG. 2, the banknote stacking and separating apparatus provided by the present embodiment includes: a frame 1, and a guide plate 41 and a pressing plate 31 that are disposed on the frame 1. The frame 1 is provided with an entrance-and-exit 20 for a banknote. One end of the guide plate 41 adjacent to the entrance-and-exit 20 is pivotally connected to the frame 1, and the guide plate 41 is rotatable around an axis of a pivoting shaft and is disposed to guide a moving direction of the banknote when the banknote is being collected. The pressing plate 31 is configured to support the collected banknote and press the banknote towards the guide plate 41 when the banknote is being separated. One end of the guide plate 41 far away from the entrance-and-exit 20 is provided with a force-releasing portion 42 to support the guide plate 41 when the pressing plate 31 presses the banknote towards the guide plate 41, thus creating a gap between the guide plate 41 and the banknote supported by the pressing plate 31.

Optionally, the banknote stacking and separating apparatus incudes a frame 1, a stacking and separating mechanism 2, a banknote pressing mechanism 3, and a guiding mechanism 4.

The frame 1 includes a housing 10 which is in a cuboid shape. An opening 11 is disposed in an upper surface of the housing 10, and a banknote storage chamber 12 and a transfer passage 13 are disposed in the housing 10. The banknote storage chamber 12 is configured for stacking and storing banknotes, and the banknotes are stacked in the banknote storage chamber 12 along a vertical direction. Along a direction of the banknotes entering the banknote storage chamber 12, the banknote storage chamber 12 is provided with a second side wall 17 and a first side wall 16, the first side wall 16 and the second side wall 17 are disposed in a relatively parallel and interval mode, and the interval between the first side wall 16 and the second side wall 17 is larger than a length of the moving direction of the banknotes when the banknotes enter the banknote storage chamber 12. And the transfer passage 13 is connected between the opening 11 and the banknote storage chamber 12, and a delivery roller or a delivery belt for driving the banknote to move along the transfer passage 13 can be further provided in the transfer passage 13.

The stacking and separating mechanism 2 is disposed between the banknote storage chamber 12 and the transfer passage 13 and is configured to drive the banknotes to move between the banknote storage chamber 12 and the transfer passage 13. The stacking and separating mechanism 2 includes a feed roller 21, a gate roller 22, a pickup roller 23, the elastic member (not shown in the figure), an impeller 24, and a motor (not shown in the figure).

The feed roller 21 and the gate roller 22 are disposed at one end of the banknote storage chamber 12 adjacent to the transfer passage 13, the feed roller 21 and the gate roller 22 are oppositely disposed, the entrance-and-exit 20 for the banknote to enter and exit the banknote storage chamber 12 is defined between the feed roller 21 and the gate roller 22. The entrance-and-exit 20 is connected with the transfer passage 13. The pickup roller 23 is provided inside the banknote storage chamber 12, and the pickup roller 23 is located upstream of the feed roller 21 in a direction of outputting the banknotes inside the banknote storage chamber 12. The pickup roller 23 is movably connected with the frame 1 and has an initial position and a banknote pickup position. A first end of the elastic member is connected to an inner wall of the frame 1, a second end of the elastic member is connected to the pickup roller 23, the frame 1 includes a third limiting portion (not shown in the figure) matched with the pickup roller 23, and the pickup roller 23 has a permanent tendency of abutting against the third limiting portion of the frame 1 under an action of the elastic force of the elastic member; the impeller 24 is coaxially connected to the gate roller 22. The motor is configured to drive the feed roller 21, the gate roller 22, the pickup roller 23 and the impeller 24 to rotate. When an output shaft of the motor rotates along a first direction, the feed roller 21, the gate roller 22 and the impeller 24 are driven to rotate along a banknote feeding direction to make the feed roller 21 and the gate roller 22 drive the banknote in the transfer passage 13 to enter the banknote storage chamber 12 through between the feed roller 21 and the gate roller 22, and blades of the impeller 24 flap a tail end of the banknote input through the feed roller 21 and the gate roller 22. When the output shaft of the motor rotates along a second direction opposite to the first direction, the impeller 24 does not rotate, the blades of the impeller 24 do not affect the banknote outputted, the motor can drive the feed roller 21 and the pickup roller 23 to rotate along the banknote output direction, the pickup roller 23 can drive the banknote contacting with the pickup roller 23 to move towards the feed roller 21, and the feed roller 21 and the gate roller 22 drive a single banknote to be input into the transfer passage 13 via the entrance-and-exit 20. The banknote feeding direction is a direction where the banknotes are input into the banknote storage chamber 12 via the entrance-and-exit 20, and the banknote output direction is a direction where the banknotes are input into the transfer passage 13 via the entrance-and-exit 20.

In the present embodiment, the pickup roller 23 is supported by the supporting frame 231, the supporting frame 231 is sleeved with a core shaft 211 of the feed roller 21, and both ends of the core shaft 211 of the feed roller 21 are supported by the housing 10, and the pickup roller 23 is operative to rotate around the core shaft 211 of the feed roller 21 along with the supporting frame 231. Due to a center of rotation of the pickup roller 23 is configured to be the core shaft 211 of the feed roller 21, i.e. a center distance between the pickup roller 23 and the feed roller 21 is not changed, a transmission gear set can be provided between the feed roller 21 and the pickup roller 23, and the motor can indirectly drive the pickup roller 23 to rotate by driving the feed roller 21 to rotate and transmitting the rotation via the transmission gear set, thereby simplifying the transmission structure between the motor and the pickup roller 23.

The banknote pressing mechanism 3 includes a pressing plate 31 and a banknote pressing driving member 32. The pressing plate 31 is disposed in the banknote storage chamber 12 and is configured for supporting the banknotes, and when the banknote stacking and separating apparatus outputs the banknote, the pressing plate 31 is further configured for pressing the banknote towards the pickup roller 23. And the banknote pressing driving member 32 is in a transmission connection with the pressing plate 31 and is configured to drive the pressing plate 31 to perform a reciprocating motion in the banknote stacking direction so that the pressing plate 31 presses the banknote or is away from the pickup roller 23 by a predetermined distance to form a space for stacking the banknote.

In the present embodiment, the banknote pressing driving member 32 includes a banknote pressing motor (not shown in the figure), a driving belt 321, and two pulleys 322, where the two pulleys 322 are disposed on the side wall of the frame 1 at intervals along the stacking direction of the banknotes, and one of the two pulleys 322 is in a transmission connection with the banknote pressing motor, the driving belt 321 is supported by the two pulleys 322, and the pressing plate 31 is fixedly connected to the driving belt 321. When the banknote pressing motor drives the pulleys 322 to rotate, the pulleys 322 drive the driving belt 321 to move along the stacking direction of the banknotes, thereby driving the pressing plate 31 to move along the stacking direction of the banknotes.

Optionally, the banknote pressing mechanism 3 further includes a plurality of guide wheels 33 disposed on both sides of the pressing plate 31, and each of the guide wheels 33 is embedded in a corresponding elongated slot 14 on the inner wall of the housing 10. A length direction of the elongated slot 14 extends in the stacking direction of the banknotes, and the guide wheels 33 moves along the elongated slot 14, so that the pressing plate 31 can move more smoothly along the stacking direction of the banknote.

The guiding mechanism 4 is disposed inside the banknote storage chamber 12 and is configured to guide the moving direction of the banknote when the banknotes are input into the banknote storage chamber 12. The guiding mechanism 4 includes the guide plate 41 and the force-releasing portion 42. One end of the guide plate 41 adjacent to the entrance-and-exit 20 is pivotally connected to the frame 1, the guide plate 41 is configured to be rotatable about an axis of the pivoting shaft, and the guide plate 41 is configured to guide the moving direction of the banknotes when the banknotes are collected. The guide plate 41 includes a guide surface 411 facing the banknote storage chamber 12, and in the absence of an external force, the guide plate 41 is rotated about the pivotal axis by its own gravity and is in cooperation with the second limiting portion 15 on the frame 1, so that the guide plate 41 is stabilized in the initial position. At this moment, the guide plate 41 is configured to hide the pickup roller 23, and the guide surface 411 is inclined towards the banknote storage chamber 12 along the banknote feeding direction. The length of the guide surface 411 is longer than that of the banknotes, and the guide surface 411 can guide the banknotes input from the entrance-and-exit 20 to move toward the pressing plate 31 without the banknotes coming into contact with the pickup roller 23. Optionally, the guide surface 411 is inclined at an angle of 15° to 25° relative to the banknote feeding direction.

One end of the guide plate 41 away from the entrance-and-exit 20 is provided with a force-releasing portion 42 configured for supporting the guide plate 41 when the pressing plate 31 presses the banknote towards the guide plate 41, thus creating a gap between the guide plate 41 and the banknote supported by the pressing plate 31. In the present embodiment, the force-releasing portion 42 is fixedly connected to the guide plate 41.

The force-releasing portion 42 is provided with a force-releasing surface 421 facing one end of the pressing plate 31 far away from the entrance-and-exit 20 and is configured to form an acute angle with a surface of the banknote supported by the pressing plate 31. When the banknote is pressed towards the guide plate 41 by the pressing plate 31, the force-releasing surface 421 contacts with an end surface of the banknote to push the banknote to move towards the entrance-and-exit 20. The force-releasing surface 421 is configured to be a plane or an arc surface that protrudes toward the pressing plate 31. In the present embodiment, the force-releasing surface 421 is configured to be a plane.

Optionally, the force-releasing portion 42 has a first end adjacent to the guide plate 41 and a second end far away from the guide plate 41, and the force-releasing surface 421 is disposed between the first end and the second end.

Figure 3:
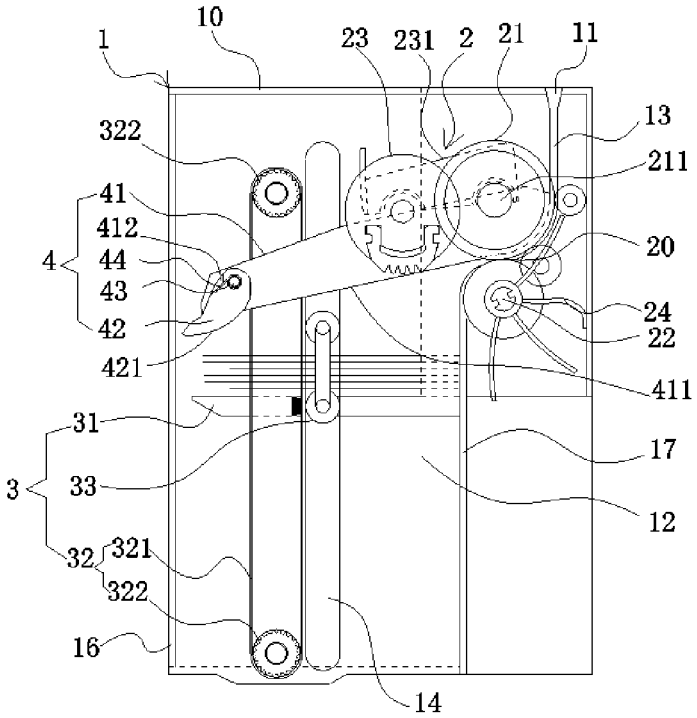
FIG. 3 is a structural schematic view of a banknote stacking and separating apparatus according to another embodiment of the present disclosure.

In other embodiments, as illustrated in FIG. 3, the force-releasing portion 42 is pivotally connected to the guide plate 41, and the force-releasing portion 42 is rotatable relative to the guide plate 41. The force-releasing surface 421 is configured to be curved that protrudes toward the pressing plate 31. The guide plate 41 is provided with a first limiting portion 412 disposed on a rotating path of the force-releasing portion 42 rotating in a direction away from the pressing plate 31. And when the force-releasing portion 42 abuts the first limiting portion 412, the force-releasing portion 42 is at the initial position. Optionally, the first end of the force-releasing portion 42 is pivotally connected to the end of the guide plate 41 far away from the entrance-and-exit 20 by a shaft 43. And when the guide plate 41 rotates about the pivotal axis, the force-releasing portion 42 is operative to rotate together with the guide plate 41. Furthermore, the second end of the force-releasing portion 42 is also rotatable about the axis of the shaft 43 relative to the guide plate 41. Under the action of its own gravity, the force-releasing portion 42 have a permanent tendency of rotating around the axis of the shaft 43 along a direction away from the pressing plate 31 until the force-releasing portion 42 moves to abut against the first limiting portion 412 on the guide plate 41, and when the force releasing portion 42 abuts against the first limiting portion 412, the force releasing portion 42 is at the initial position, the second end of the force-releasing portion 42 extends to a side of the pressing plate 31 far away from the entrance-and-exit 20, and the force-releasing surface 421 faces the surface of the banknote supported by the pressing plate 31.

Optionally, the guiding mechanism further includes a first elastic member 44, and the first elastic member 44 is connected between the guide plate 41 and the force-releasing portion 42 and is configured to make the force-releasing portion 42 to have a permanent tendency of rotating toward the initial position. Optionally, the first end of the elastic member 44 is connected to the guide plate 41, and the second end of the elastic member 44 is connected to the force-releasing portion 42. Under the action of the elastic force of the elastic member 44, the force-releasing portion 42 have a permanent tendency of abutting the first limiting portion 412 on the guide plate 41 to make the force-releasing portion 42 be located at the initial position. And by providing the elastic member 44, even if the banknote stacking and separating apparatus is tilted and the position thereof is changed, the force-releasing portion 42 can still be located at the initial position, and the structure is more stable.

The banknote stacking and separating apparatus further includes a blocking portion 18 disposed on the frame 1. When the force-releasing portion 42 at the initial position rotates along with the guide plate 41 in the direction away from the pressing plate 31, the force-releasing portion 42 is in contact with the blocking portion 18. As the guide plate 41 continues to rotate, the blocking portion 18 is configured to make the force-releasing portion 42 to rotate relative to the guide plate 41 in the direction of nearing the pressing plate 31, so that the guide plate 41 is supported by the force-releasing portion 42. And when the force-releasing portion 42 rotates relative to the guide plate 41 in the direction of nearing the pressing plate 31, the force-releasing surface 421 pushes the banknotes contacted with the force-releasing surface 421 to move towards the entrance-and-exit 20. Optionally, the second end of the force-releasing portion 42 is restricted from continuing to move upward by the blocking portion 18, which is optionally a side wall of the housing 10. In the present embodiment, the first side wall 16 is used as a blocking portion, and when the force-releasing portion 42 is rotated upward by a set angle along with the guide plate 41, the first side wall 16 contacts with the second end of the force-releasing portion 42 to prevent the second end of the force-releasing portion 42 from continuing to move upward. In the present embodiment, the first side wall 16 is used as the blocking portion to make the structure more compact. In other embodiments, the blocking portion 18 may be a riveting column or the like provided at a set position.

In the present embodiment, one end of the guide plate 41 is sleeved on the core shaft 211 of the feed roller 21 via a shaft sleeve, and the guide plate 41 can rotate around the core shaft 211 of the feed roller 21. Because the guide plate 41 is directly sleeved on the core shaft 211 of the feed roller 21, a separate rotating shaft is not required to be additionally provided to pivotally connect the guide plate 41 to the housing 10, thereby reducing the number of the components.

Optionally, the guide surface 411 is configured to be a smooth surface with a small friction coefficient to reduce a frictional resistance when the banknote contacts with the guide surface 411. Optionally, the force-releasing surface 421 is configured to be a smooth surface with a small friction coefficient to reduce a frictional resistance when the banknote contacts with the force-releasing surface 421.

Figure 4:
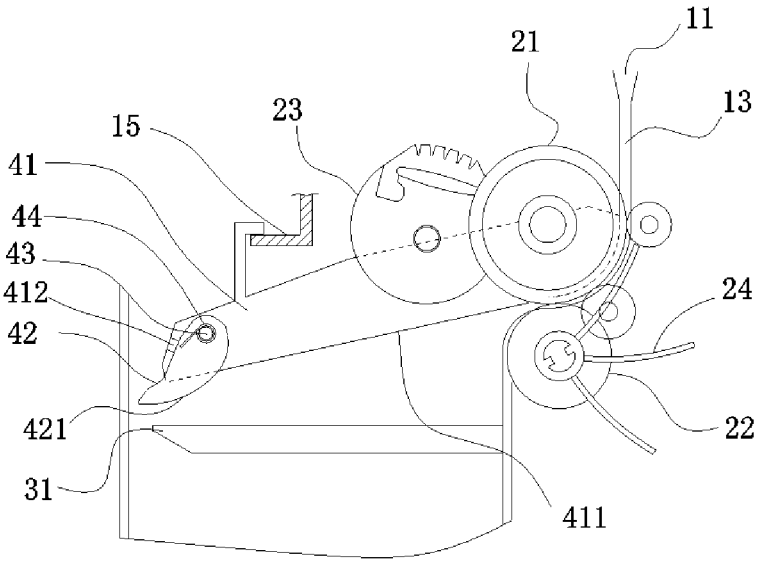
FIG. 4 is a first structural schematic view illustrating a partial structure of a banknote stacking and separating apparatus according to yet another embodiment of the present disclosure.

When the banknote stacking and separating apparatus collects banknotes, as shown in FIG. 4, first the banknote pressing driving member 32 is controlled to drive the pressing plate 31 to move a set distance in a direction away from the pickup roller 23, and the supporting frame 231 abuts the third limiting portion of the frame 1 under the action of the elastic member to make the pickup roller 23 be located at the initial position. The guide plate 41 of the guiding mechanism 4 abuts the second limiting portion 15 of the housing 10 under the action of itself gravity, the force-releasing portion 42 is at the initial position, the guide plate 41 hides the pickup roller 23, the guide surface 411 inclines towards the banknote storage chamber 12, the force releasing surface 421 faces the pressing plate 31, and a space for stacking banknotes is formed between the pressing plate 31 and the guide plate 41. Then, the motor is controlled to drive the feed roller 21 and the gate roller 22 to rotate along the banknote feeding direction, the banknotes in the transfer passage 13 are driven to be input into the banknote storage chamber 12 via the entrance-and-exit 20, and a front end of the banknotes are brought into contact with the guide surface 411 of the guide plate 41 and moved toward the pressing plate 31 under the guide of the guide surface 411. And finally the banknotes are stacked on the pressing plate 31.

Figure 5:
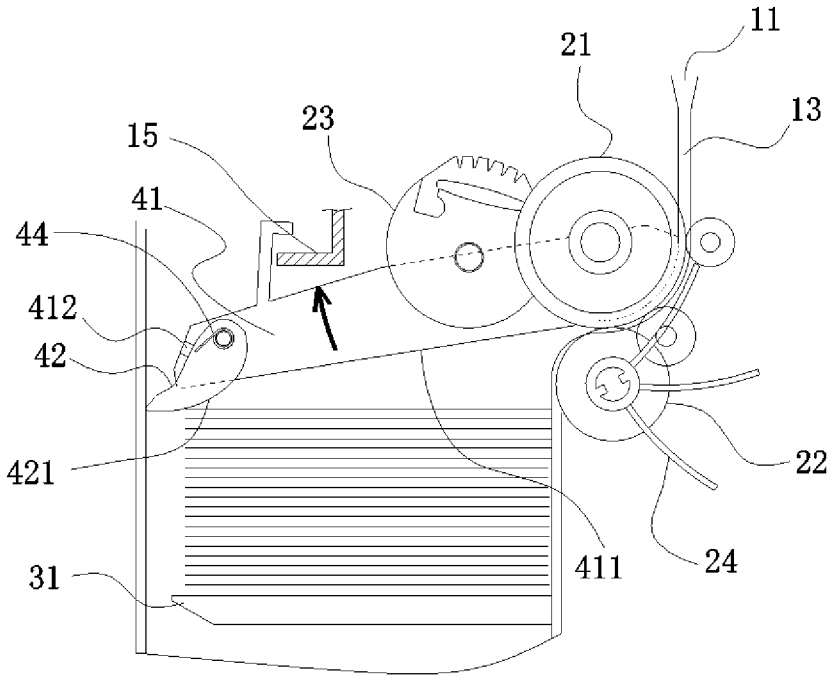
FIG. 5 is a second structural schematic view illustrating a partial structure of a banknote stacking and separating apparatus according to yet another embodiment of the present disclosure.
Figure 6:
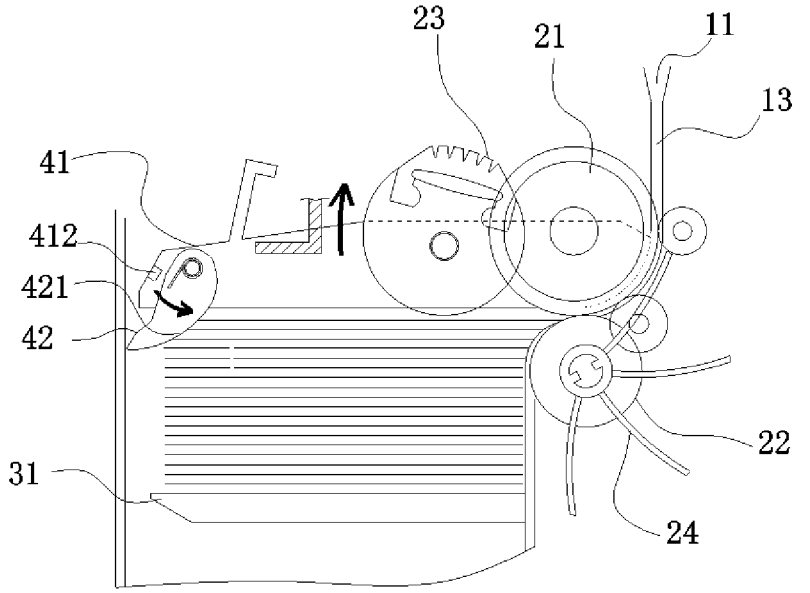
FIG. 6 is a third structural schematic view illustrating a partial structure of a banknote stacking and separating apparatus according to yet another embodiment of the present disclosure.
Figure 7:
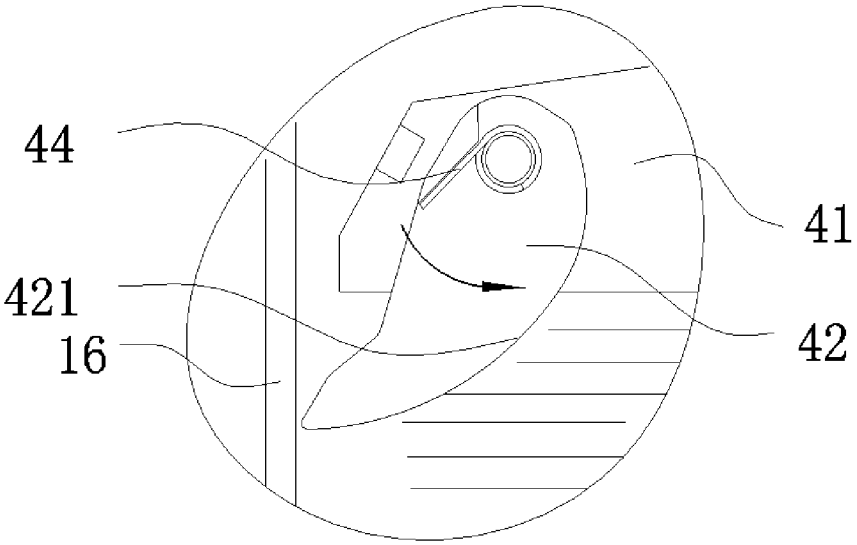
FIG. 7 is an enlarged structural schematic view illustrating a partial structure of a banknote stacking and separating apparatus according to yet another embodiment of the present disclosure.

When the banknote stacking and separating apparatus separates banknotes, first the banknote pressing driving member 32 is controlled to drive the pressing plate 31 to move toward a direction (i.e., the direction of nearing the guide plate 41) of nearing the pickup roller 23. As shown in FIG. 5, the end surface of the uppermost one of the banknotes stacked on the pressing plate 31 first contacts with the force-releasing surface 421 of the force-releasing portion 42 to exert an upward force to the force-releasing portion 42, and because the force-releasing portion 42 abuts the first limiting portion 412, the pressing plate 31 drives the force-releasing portion 42 to drive the guide plate 41 to move upward together via the first limiting portion 412, so that the guide plate 41 drives the force-releasing portion 42 to rotate upward together by a set angle, the first side wall 16 contacts with the second end of the force-releasing portion 42, as shown in FIGS. 6 and 7, the second end of the force-releasing portion 42 is blocked by the first side wall 16 from moving further upward, and the guide plate 41 continues to rotate upward, so that the force-releasing portion 42 rotates about the shaft 43 relative to the guide plate 41 in the direction indicated by an arrow in FIG. 6 to make the second end of the force-releasing portion 42 located on the side of the pressing plate 31 far away from the entrance-and-exit 20 rotate in a direction of nearing the entrance-and-exit 20, the force-releasing surface 421 pushes the end surfaces of several pieces of banknotes above the banknotes stacked on the pressing plate 31 towards the entrance-and-exit 20, the several pieces of banknotes above the banknotes stacked on the pressing plate 31 are driven to be sequentially inclined to the entrance-and-exit 20, and a front end of the uppermost one piece of banknote abuts and is aligned with the gate roller 22 or the feed roller 21, at the same time, the force-releasing portion 42 supports up the guide plate 41, the guide plate 41 exposes the pickup roller 23, and the pressing plate 31 is controlled to stop moving towards the pickup roller 23. And finally, the motor of the stacking and separating mechanism 2 is controlled to drive the pickup roller 23 and the feed roller 21 to rotate along the banknote output direction, and the banknotes are output outwards.

When the banknote stacking and separating apparatus in the related art separates banknotes, the frictional force between a guide plate and the banknote prevents the banknote from moving towards the entrance-and-exit due to the fact that the guide plate is lapped on the banknote, which is not favorable for smooth separation of the banknote. The banknote stacking and separating apparatus and the banknote processing device in the present embodiment include the frame 1, the guide plate 41 and the pressing plate 31 disposed on the frame 1, one end of the guide plate 41 far away from the entrance-and-exit 20 is provided with a force-releasing portion 42, and the force-releasing portion 42 is configured to support the guide plate 41 when the pressing plate 31 presses the banknotes towards the guide plate 41, thus creating a gap between the guide plate 41 and the banknotes supported by the pressing plate 31. When the banknotes are separated, the pressing plate 31 moves towards the guide plate 41, the force-releasing portion 42 is in contact with the banknote, and the guide plate 41 is supported by the force-releasing portion 42 under the action of the pressing plate 31 to create a gap between the guide plate 41 and the banknote. Compared with those provided in the related art, the banknote stacking and separating apparatus provided by the present embodiment has advantages that when the banknotes are separated, the force-releasing portion 42 is operative to support the guide plate 41, so that the guide plate 41 does not contact with banknote, and the force-releasing portion 42 only contacts an end of the banknote, so that the guide plate 41 does not block the separation and output of the banknote, and it is guaranteed the banknote stacking and separating apparatus can steadily separate banknotes. Optionally, the force-releasing portion 42 pushes the banknote to move towards the entrance-and-exit 20, which is beneficial for the banknote separation of the stacking and separating mechanism and improves the stability of the banknote separation of the banknote stacking and separating apparatus.

Figure 8:
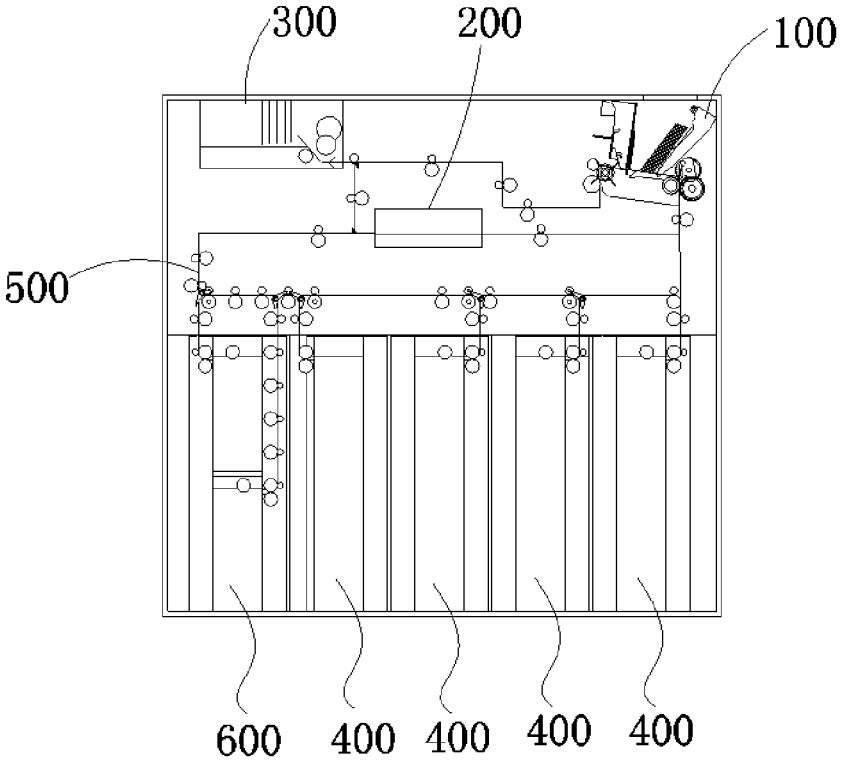
FIG. 8 is a structural schematic view illustrating a banknote processing apparatus according to yet another embodiment of the present disclosure.

FIG. 8 is a structural schematic view of a banknote processing device according to an embodiment of the present disclosure. As illustrated in FIG. 8, in the present embodiment, the banknote processing apparatus is a deposit and withdrawal machine including a deposit and withdrawal port mechanism 100, an identification mechanism 200, a temporary storage mechanism 300, a banknote circulating box 400, a delivery mechanism 500, and a recovery box 600. The deposit and withdrawal port mechanism 100 is configured to feed banknotes which are put in by the user to the identification mechanism 200 one by one or to output banknotes identified by the identification mechanism 200 one by one for the user to take away. The identification mechanism 200 is configured to perform banknote detection and identification, the temporary storage mechanism 300 is configured to temporarily store banknotes, the banknote circulating box 400 is configured to collect and separate the banknotes, and the structural form and the working principle of the banknote circulating box 400 are the same as those of the banknote stacking and separating apparatus provided in the above-mentioned embodiments. The recovery box 600 is configured to store banknotes that are no longer circulating, and the delivery mechanism 500 is configured to deliver banknotes between the plurality of mechanisms and between each mechanism and the banknote circulating box 400 and the recovery box 600.

The banknote processing device according to the present embodiment uses the banknote stacking and separating apparatus of embodiments of the present disclosure, thereby achieving the banknote separating function in a stable and reliable manner.

INDUSTRIAL APPLICABILITY

When separating the banknotes using the banknote stacking and separating apparatus and the banknote processing device provided by the present disclosure, the guide plate wouldn't contact with banknote because the guide plate is lifted up by the force-releasing portion. Furthermore, the force-releasing portion only contacts with the end portion of the banknote. Therefore, the guide plate wouldn't block the separation and output of the banknote, ensuring that the banknote stacking and separating apparatus separate banknotes in a steady manner.

What is claimed is:

1. A banknote stacking and separating apparatus, comprising:

a frame, and a guide plate and a pressing plate that are disposed on the frame;

wherein the frame is provided with an entrance-and-exit for a banknote;

wherein one end of the guide plate adjacent to the entrance-and-exit is pivotally connected to the frame, and the guide plate is operative to rotate around an axis of a pivoting shaft and is configured to guide a moving direction of the banknote while the banknote is being collected;

wherein the pressing plate is configured to support collected banknotes and press the banknotes towards the guide plate while the banknotes are being separated; and wherein one end of the guide plate far away from the entrance-and-exit is provided with a force-releasing portion configured for supporting the guide plate while the pressing plate is pressing the banknotes towards the guide plate, thus creating a gap between the guide plate and the banknotes supported by the pressing plate.

2. The banknote stacking and separating apparatus of claim 1, wherein the force-releasing portion has a force-releasing surface facing an end of the pressing plate far away from the entrance-and-exit, and wherein the force-releasing surface forms an acute angle with a surface of the pressing plate for supporting the banknotes.

3. The banknote stacking and separating apparatus of claim 2, wherein while the pressing plate is pressing the banknotes toward the guide plate, the force-releasing surface is operative to contact with an end surface of the banknotes and push the banknotes to move toward the entrance-and-exit.

4. The banknote stacking and separating apparatus of claim 2, wherein the force-releasing surface is a plane or an arc surface protruding toward the pressing plate.

5. The banknote stacking and separating apparatus of claim 2, wherein the force-releasing portion is pivotally connected to the guide plate, and is rotatable relative to the guide plate, wherein the guide plate is provided with a first limiting portion disposed on a rotating path of the force-releasing portion rotating toward a direction away from the pressing plate, wherein the force-releasing portion is at an initial position when it abuts against the first limiting portion.

6. The banknote stacking and separating apparatus of claim 5, further comprising a first elastic member connected between the guide plate and the force-releasing portion and is configured to allow the force-releasing portion to have a permanent tendency of rotating toward the initial position.

7. The banknote stacking and separating apparatus of claim 5, further comprising a blocking portion disposed on the frame, wherein when the force-releasing portion at the initial position rotates along with the guide plate in a direction away from the pressing plate, the blocking portion is configured to make the force-releasing portion rotate relative to the guide plate in a direction of nearing the pressing plate, allowing the force-releasing portion to support the guide plate.

8. The banknote stacking and separating apparatus of claim 7, wherein when the force-releasing portion rotates relative to the guide plate in the direction of nearing the pressing plate, the force-releasing surface is operative to push the banknote contacting with the force-releasing surface to move towards the entrance-and-exit.

9. The banknote stacking and separating apparatus of claim 7, wherein the frame comprises a housing, and the blocking portion is a side wall of the housing.

10. A banknote processing device, comprising a banknote stacking and separating apparatus, the banknote stacking and separating apparatus comprising:

a frame, provided with an entrance-and-exit for a banknote;

a guide plate, wherein one end of the guide plate adjacent to the entrance-and-exit is pivotally connected to the frame, and the guide plate is operative to rotate around an axis of a pivoting shaft and is configured to guide a moving direction of the banknote while the banknote is being collected; and a pressing plate, configured to support collected banknotes and press the banknotes towards the guide plate while the banknotes are being separated;

wherein one end of the guide plate far away from the entrance-and-exit is provided with a force-releasing portion configured for supporting the guide plate while the pressing plate is pressing the banknotes towards the guide plate, thus creating a gap between the guide plate and the banknotes supported by the pressing plate.

11. The banknote processing device of claim 10, wherein force-releasing portion has a force-releasing surface facing an end of the pressing plate far away from the entrance-and-exit, and wherein the force-releasing surface forms an acute angle with a surface of the pressing plate for supporting the banknote.

12. The banknote processing device of claim 11, wherein in response to the pressing plate pressing the banknotes toward the guide plate, the force-releasing surface is operative to contact with an end surface of the banknote and push the banknote to move toward the entrance-and-exit.

13. The banknote processing device of claim 11, wherein the force-releasing surface is a plane or an arc surface protruding toward the pressing plate.

14. The banknote processing device of claim 11, wherein the force-releasing portion is pivotally connected to the guide plate, and is rotatable relative to the guide plate, wherein the guide plate is provided with a first limiting portion disposed on a rotating path of the force-releasing portion rotating toward a direction away from the pressing plate, wherein the force-releasing portion is at an initial position when it abuts against the first limiting portion.

15. The banknote processing device of claim 14, wherein the banknote stacking and separating apparatus further comprises a first elastic member connected between the guide plate and the force-releasing portion and is configured to allow the force-releasing portion to have a permanent tendency of rotating toward the initial position.

16. The banknote processing device of claim 14, wherein the banknote stacking and separating apparatus further comprises a blocking portion disposed on the frame, and wherein when the force-releasing portion at the initial position rotates along with the guide plate in a direction away from the pressing plate, the blocking portion is configured to make the force-releasing portion rotate relative to the guide plate in a direction of nearing the pressing plate, allowing the force-releasing portion to support the guide plate.

17. The banknote processing device of claim 16, wherein when the force-releasing portion rotates relative to the guide plate in the direction of nearing the pressing plate, the force-releasing surface is operative to push the banknote contacting with the force-releasing surface to move towards the entrance-and-exit.

18. The banknote stacking and separating apparatus of claim 3, wherein the force-releasing portion is pivotally connected to the guide plate, and is rotatable relative to the guide plate, wherein the guide plate is provided with a first limiting portion disposed on a rotating path of the force-releasing portion rotating toward a direction away from the pressing plate, and wherein the force-releasing portion is at an initial position when it abuts against the first limiting portion.

19. The banknote stacking and separating apparatus of claim 18, further comprising a first elastic member connected between the guide plate and the force-releasing portion and is configured to allow the force-releasing portion to have a permanent tendency of rotating toward the initial position.

20. The banknote stacking and separating apparatus of claim 4, wherein the force-releasing portion is pivotally connected to the guide plate, and is rotatable relative to the guide plate, wherein the guide plate is provided with a first limiting portion disposed on a rotating path of the force-releasing portion rotating toward a direction away from the pressing plate, wherein the force-releasing portion is at an initial position when it abuts against the first limiting portion.

* * * * *